US008113122B2

(12) United States Patent
Tarr

(10) Patent No.: US 8,113,122 B2
(45) Date of Patent: Feb. 14, 2012

(54) TRESTLE SUPPORT APPARATUS

(76) Inventor: Robert J. Tarr, Willoughby, OH (US)

( * ) Notice: Subject to any disclaimer, the term of this patent is extended or adjusted under 35 U.S.C. 154(b) by 236 days.

(21) Appl. No.: 11/972,994

(22) Filed: Jan. 11, 2008

(65) Prior Publication Data

US 2008/0169353 A1 Jul. 17, 2008

Related U.S. Application Data

(60) Provisional application No. 60/879,898, filed on Jan. 11, 2007.

(51) Int. Cl.
*B61B 5/02* (2006.01)

(52) U.S. Cl. ... 104/124; 238/10 E; 104/125; 104/DIG. 1

(58) Field of Classification Search ..... 104/124, 104/125, 126, DIG. 1; 446/122, 446, 447; 238/10 E
See application file for complete search history.

(56) References Cited

U.S. PATENT DOCUMENTS 1,828,536 A * 10/1931 Koerber ..... 104/56
2,919,515 A 1/1960 Connell
3,225,487 A 12/1965 Mallalieu
4,096,658 A 6/1978 Neuhierl
4,352,329 A * 10/1982 Fetty et al. ..... 104/305
4,826,076 A 5/1989 Hesse
5,370,308 A 12/1994 Black
5,456,410 A 10/1995 Chow
5,779,145 A 7/1998 Zelle et al.
5,924,778 A * 7/1999 TenBrink ..... 312/114
5,979,783 A 11/1999 Toht et al.
6,009,812 A * 1/2000 Ernst ..... 104/125
6,155,177 A 12/2000 Backfisch
6,612,533 B2 * 9/2003 Biles et al. ..... 248/354.1

* cited by examiner

*Primary Examiner* — Joe Morano, IV
*Assistant Examiner* — Zachary Kuhfuss
(74) *Attorney, Agent, or Firm* — Fay Sharpe LLP

(57) ABSTRACT

A trestle support apparatus for use with a model track assembly is provided. The model track assembly includes track sections and trestles of a first configuration and separate track sections and trestles of a second configuration. The trestle support apparatus includes an elongated base including an elongated channel dimensioned to releasably receive and support a trestle of a first configuration. First and second stanchions are releasably mounted to the base.

24 Claims, 9 Drawing Sheets

TRESTLE SUPPORT APPARATUS

CROSS REFERENCE TO RELATED APPLICATIONS

This application claims priority from U.S. Provisional Patent Application Ser. No. 60/879,898 filed Jan. 11, 2007, which is expressly incorporated herein by reference, in its entirety.

BACKGROUND

The present disclose generally relates to a model track assembly and specifically to a support apparatus suitable for supporting a conventional trestle for a model track assembly, such as a model railroad track assembly and model racecar track assembly.

Hobby enthusiasts for many years have enjoyed the operation of model railroad trains and model racecars, both of the type in which separate track sections are removably joined together to form a closed path designed by the hobbyist over which a model train or racecar will travel. In the simplest form, a section of track includes a pair of spaced apart, electrically conductive rails and an arrangement of ties extending between the rails, the rails being joined together to form the track section into the desired configuration. The rails form a closed electrical circuit when the track sections are joined together in a closed configuration or pattern. Means are provided for supplying electrical energy to the rails of the assembled track sections to energize the model train or racecar traveling thereon. The track sections range in size and shape. There are countless possibilities for individual track sections: some are straight; some feature switching mechanisms; some are curved having various radii; and, some are ascending for connection to another track positioned at a higher level.

One of the problems facing designers today is the connection of incoming, ascending segments to other track sections, which are positioned at a different height than the incoming, ascending segments. Generally, track support apparatuses, such as trestles, are used to support such ascending track sections. Trestles may be used individually but are typically arranged in series. For example, a typical figure-8-shaped course includes elevated track sections which cross at the center of the figure-8 at differing levels. The track sections are supported at an incline and decline by gradually ascending and descending trestles. However, prior art support apparatuses fail to provide adequate stability to such track sections ascending above the figure-8-shaped course.

It is also popular to suspend model tracks from architectural structures, such as ceilings, within restaurants, retail outlets, homes, and the like. Suspended model railroad tracks are aesthetically pleasing and add substantially to the enjoyment of being in such places. Diners, customers, friends, and relatives all enjoy watching model trains travel upon such suspended tracks. However, suspending model railroad tracks from architectural structures requires custom installation involving attachment of the track sections and support apparatuses to the architectural structure, typically via suspension members. Thus, each track section and support apparatus must be individually installed specifically to suit its particular location. Additionally, it is frequently desirable to install model railroad track outdoors, such as in garden environments, for example. Thus, it would similarly be beneficial to provide support apparatuses for supporting model railroad tracks and trestles above such surfaces as soil, stone, concrete, floors, etc.

Accordingly, the present disclosure provides a new and improved trestle support apparatus which overcomes the difficulties with the prior art designs.

BRIEF DESCRIPTION

In accordance with one aspect of the present disclosure, a trestle support apparatus for use with a model track assembly is provided. The model track assembly includes track sections and trestles of a first configuration and separate track sections and trestles of a second configuration. The trestle support apparatus comprises an elongated base including an elongated channel dimensioned to releasably receive and support a trestle of a first configuration. First and second stanchions are releasably mounted to the base.

In accordance with another aspect of the present disclosure, a trestle support apparatus comprises an elongated base including a platform and first and second arms extending outwardly from the platform. The platform and the first and second arms define an elongated channel dimensioned to releasably receive and support a trestle of a first configuration. First and second stanchions are releasably mounted to the base. The first and second stanchions are in spaced apart relation such that at least two parallel track sections can be positioned beneath the base.

In accordance with yet another aspect of the present disclosure, a trestle support apparatus comprises an elongated base including an elongated channel dimensioned to releasably receive and support a trestle of a first configuration. First and second stanchions are releasably mounted to the base. Each of the first and second stanchions include a first end section configured to be releasably mounted beneath the base and a second end section configured to be releasably mounted within the elongated channel.

Still other aspects of the present disclosure will become apparent from a reading and understanding of the detailed description of the several embodiments described hereinbelow.

BRIEF DESCRIPTION OF THE DRAWINGS

The present disclosure may take physical form in certain parts and arrangements of parts, several embodiments of which will be described in detail in this specification and illustrated in the accompanying drawings which form a part of the disclosure.

DETAILED DESCRIPTION

Figure 1:
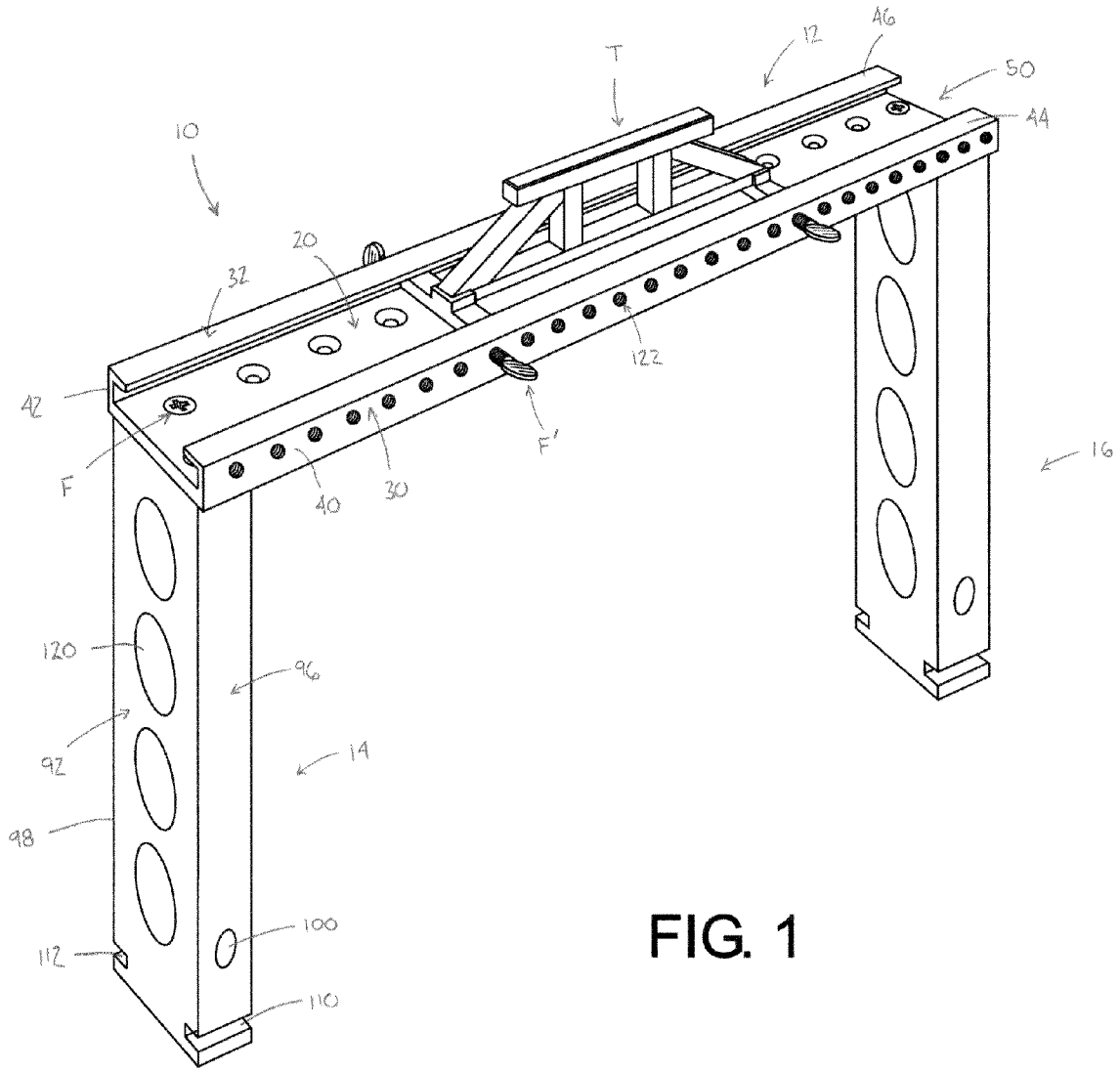
FIG. 1 is a front perspective view of an assembled trestle support apparatus according to the present disclosure, the trestle support apparatus having a first conventional trestle mounted thereto.

It should, of course, be understood that the description and drawings herein are merely illustrative and that various modifications and changes can be made in the structures disclosed without departing from the scope and spirit of the present disclosure. All references to direction and position, unless otherwise indicated, refer to the orientation of the trestle support apparatus illustrated in the drawings and should not be construed as limiting. It will also be appreciated that the various identified components of the trestles and support apparatus disclosed herein are merely terms of art that may vary from one model track manufacturer to another and should not be deemed to limit the present disclosure.

Referring now to the drawings, wherein like numerals refer to like parts throughout the several views, FIG. 1 illustrates a trestle support apparatus, generally designated by reference numeral 10, in accordance with the present disclosure. The trestle support apparatus 10 includes an elongated base 12 and first and second stanchions or legs 14 and 16, respectively, releasably mounted to the base. The first and second stanchion 14, 16 are of equal height and such height can differ depending on the configuration of the ascending track sections mounted to the trestle support apparatus. In this embodiment, the trestle support apparatus is generally U-shaped and the first and second stanchions 14, 16 stand in spaced apart relation such that at least two parallel track sections can be positioned under the base. The trestle support apparatus can be fabricated out of a durable material, such as a plastic material. As will be described in greater detail below, the base 12 is configured such that the first and second stanchions 14, 16 are connectable to the base at several predetermined locations along its longitudinal extent.

Figure 5:
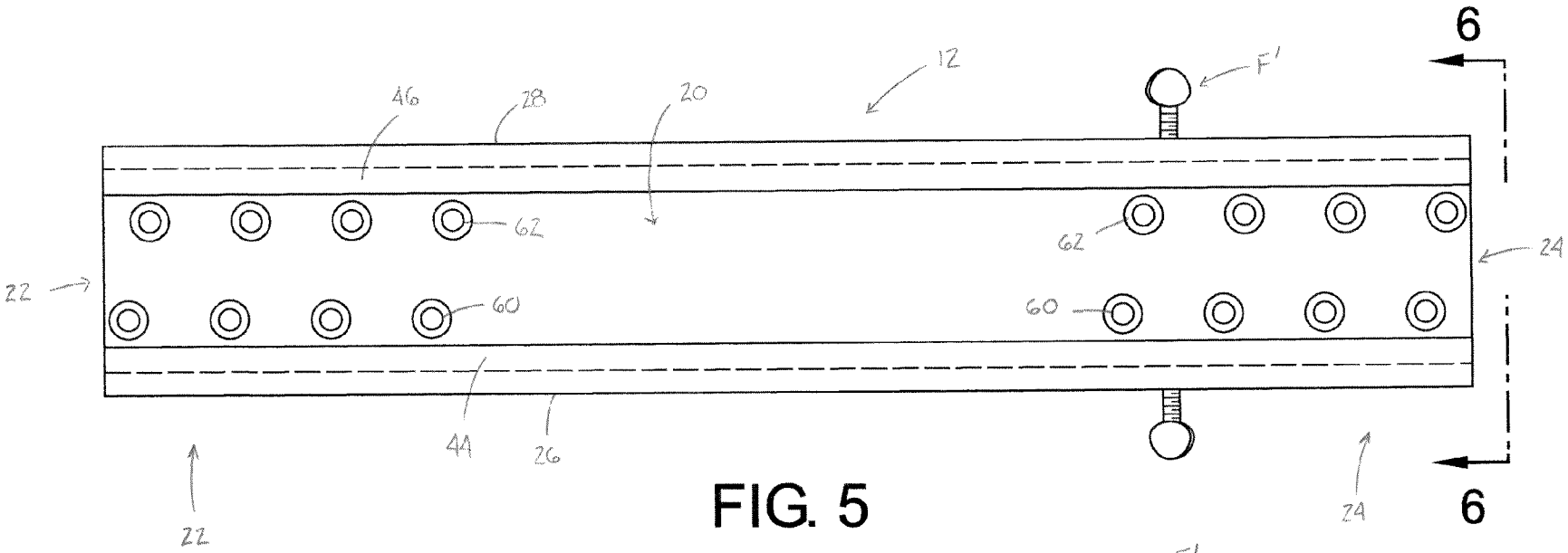
FIG. 5 is a top plan view of a base of the trestle support apparatus of FIG. 1.

With reference to FIGS. 1 and 5, the base 12 includes an elongated platform 20 having opposed end sections 22, 24 and opposed side edges 26, 28. First and second arms 30 and 32, respectively, are connected to opposed side edges and extend outwardly therefrom. Each arm 30, 32 includes a respective upwardly extending side wall 40, 42 and a respective inwardly extending top wall 44, 46. The arms and the base platform together define an elongated channel 50. As will be described in greater detail below, the channel is dimensioned to releasably receive a first conventional trestle T of a first configuration and/or an adapter 200 (FIG. 12) configured to support a second conventional trestle T' of a second configuration.

Figure 7:
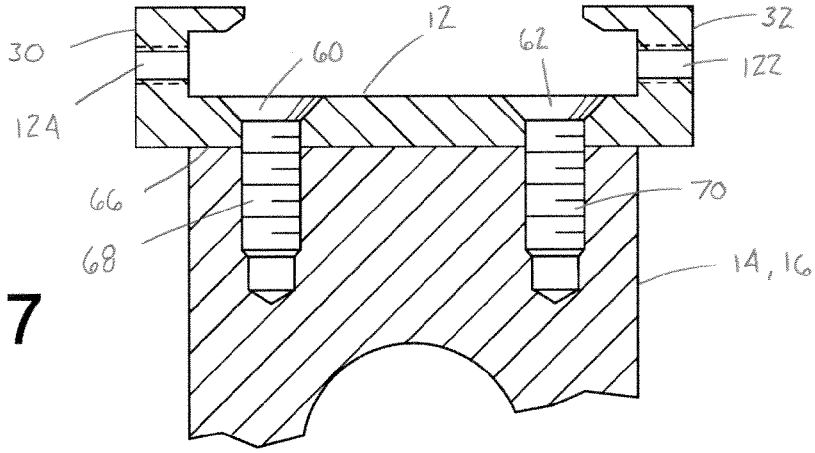
FIG. 7 is a partial cross-sectional view of the trestle support apparatus of FIG. 1 illustrating a fastening means for mounting the stanchion to the base.

Each end section 22, 24 of the platform 20 includes a first partial row of equally spaced apart first apertures 60 formed therethrough and a second partial row of equally spaced apertures 62 formed therethrough. The apertures 60, 62 are dimensioned to receive conventional fasteners F (FIG. 1) which secure the first and second stanchions 14 and 16 to the base 12. Particularly, and as shown in FIG. 7, a top wall 66 of each stanchion 14, 16 includes at least one threaded aperture which aligns with one of the apertures 60, 62 located on the base. In the depicted embodiment, the top wall includes a pair of threaded apertures 68, 70. Each fastener extends through one of the base apertures 60, 62 and threadingly engages one of the stanchion apertures 68, 70.

Figure 8:
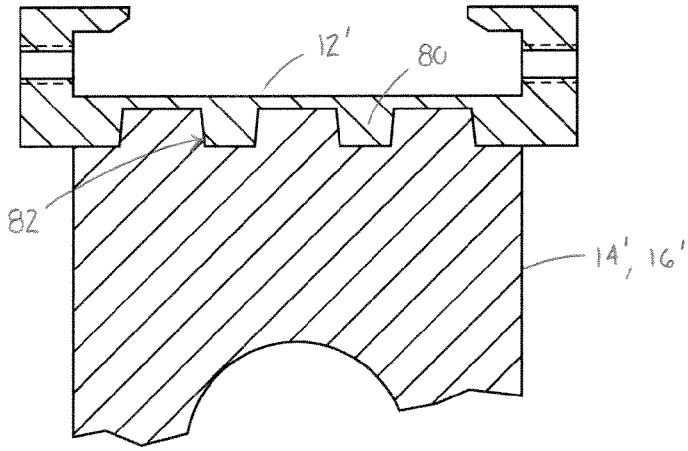
FIG. 8 is a partial cross-sectional view of the trestle support apparatus of FIG. 1 illustrating an alternative fastening means for mounting the stanchion to the base.
Figure 9:
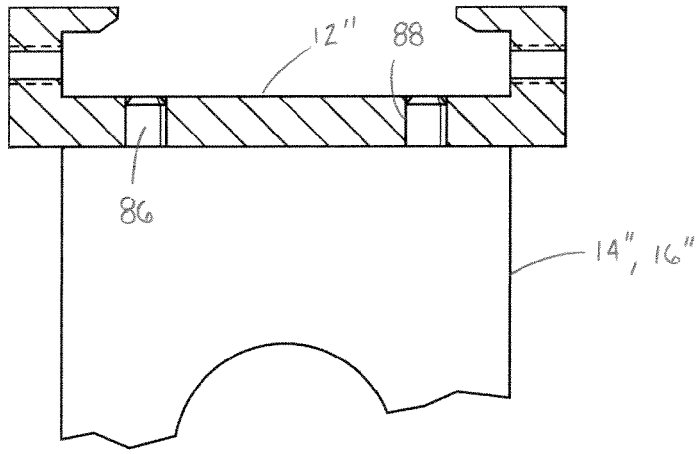
FIG. 9 is a partial cross-sectional view of the trestle support apparatus of FIG. 1 illustrating another alternative fastening means for mounting the stanchion to the base.

It should be appreciated that alternate means for securing the stanchions to the base are also contemplated. For example, as shown in FIG. 8, the support apparatus 10 can have a Lego®-like configuration wherein one of the base 12' and the stanchions 14', 16' includes coupling protrusions 80 and the other includes receiving cavities 82. Alternatively, as shown in FIG. 9, one of the base 12" and the stanchions 14", 16" can include a pin-like projection 86 and the other can include a complementary socket 88. Alternatively, one of the base and the stanchions can include a head (not shown) having a squared dovetail shape and the other can include a complementary channel (not shown).

Figure 4:
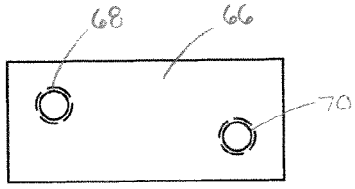
FIG. 4 is a top plan view of the stanchion of FIG. 2.
Figure 2:
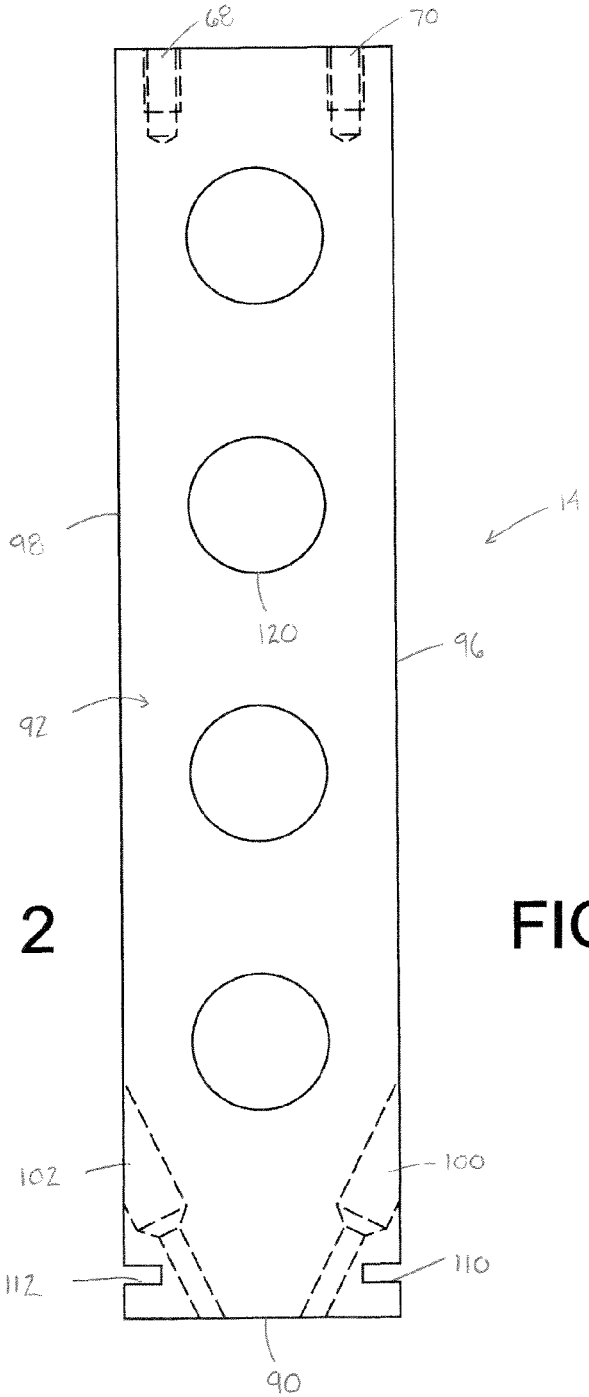
FIG. 2 is a side elevational view of a stanchion of the trestle support apparatus of FIG. 1.
Figure 3:
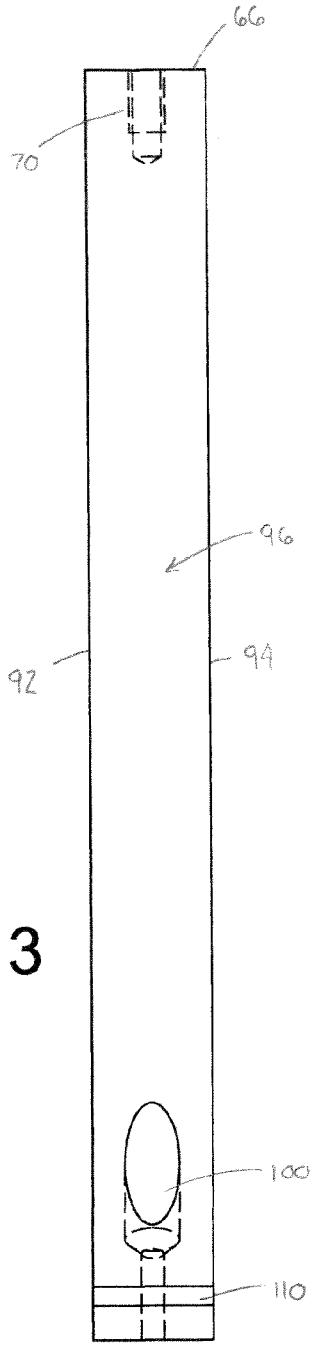
FIG. 3 is a front elevational view of the stanchion of FIG. 2.

As will also be understood and appreciated by those skilled in the art, the first and second stanchions 14, 16 can be generally identical, and thus only first stanchion 14 will be described in further detail herein. With reference now to FIGS. 2-4, first stanchion 14 is generally rectangular in shape and includes the top wall 66, a bottom wall 90, opposed side walls 92, 94 and opposed front and back walls 96, 98. It should be appreciated that alternate shapes and configurations of the stanchions are contemplated. For example, the stanchions of the present disclosure may be configured to have round, triangular, hexagonal, octagonal, etc., cross-sections. Further, the stanchions can be molded to have a trestle-like configuration similar to one of the first or second conventional trestles. Provided on at least one of the front and back walls is a mounting aperture. In the depicted embodiment, each front and back wall 96, 98 includes a respective mounting aperture 100, 102. Each mounting aperture extends diagonally though the stanchion and is dimensioned to receive a conventional fastener (not shown) for securing the stanchion to a generally flat, subjacent surface, such as a floor.

Figure 10:
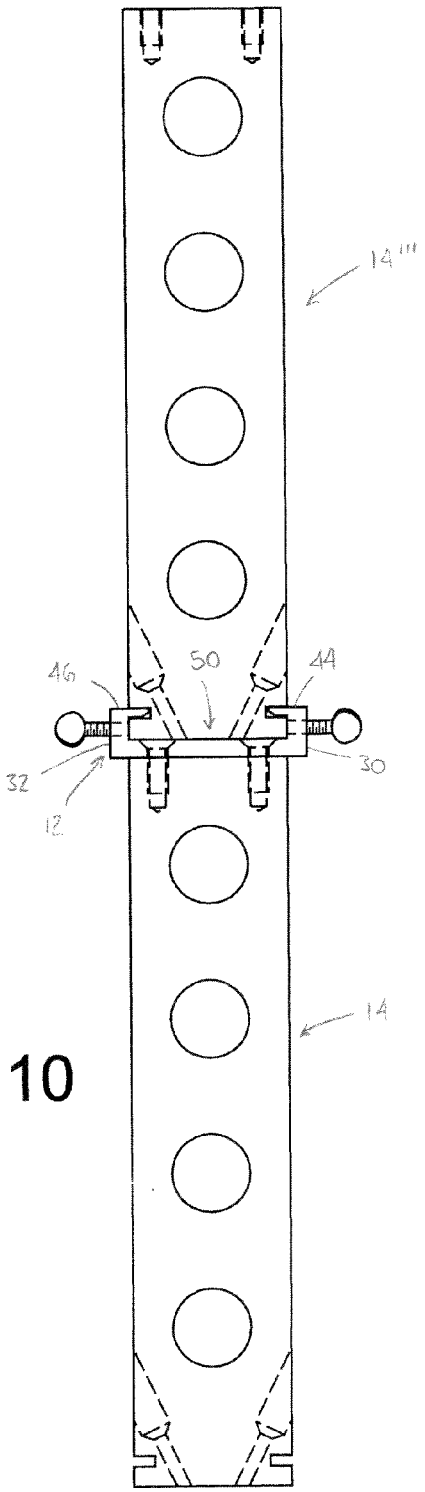
FIG. 10 is a side elevational view of the trestle support apparatus of FIG. 1 showing a stanchion of a second trestle support apparatus mounted to the base of the trestle support apparatus of FIG. 1.
Figure 11:
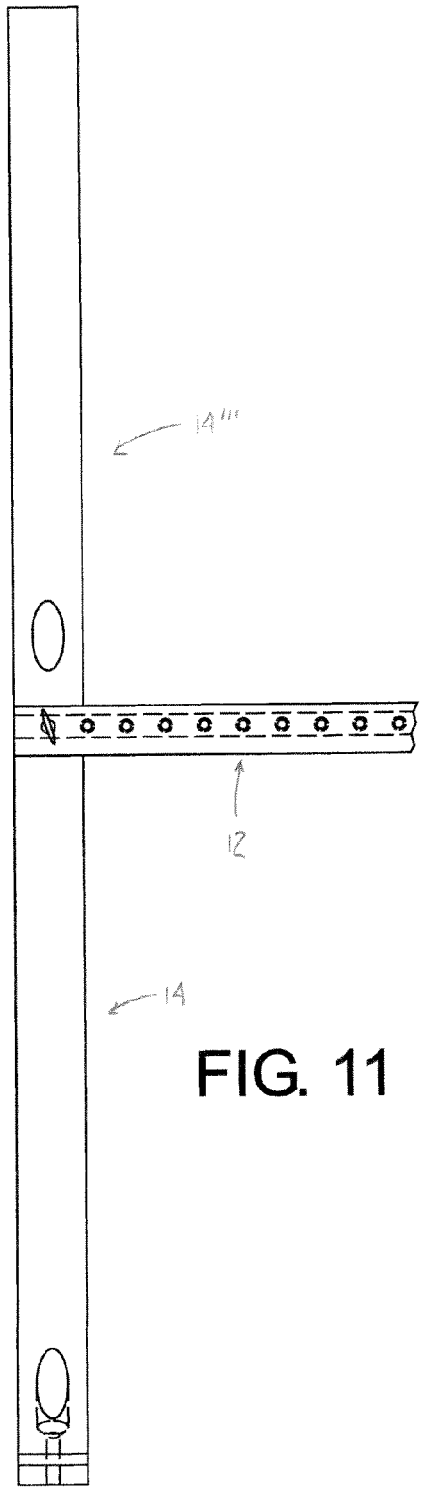
FIG. 11 is a front elevational view of FIG. 10.

A groove 110, 112 is located on each front and back wall 96, 98 of the stanchion 14. As shown in FIGS. 10 and 11, the grooves are spaced from the bottom wall 90 a predetermined distance such that a stanchion 14''' of a second trestle support apparatus can be mounted to trestle support apparatus 10. More particularly, the grooves are dimensioned to slidingly receive at least a portion of each respective top wall 44, 46 of each arm 30, 32 of the base 12. Once positioned in the channel 50, the top walls provide stability against deflecting forces directed to the second trestle support apparatus. This allows for the stacking of the trestle support apparatuses, which, in turn, allows for the placement of additional ascending track sections. To reduce the weight of the trestle support apparatus 10, each stanchion 14, 16 can include at least one through hole 120.

Figure 6:
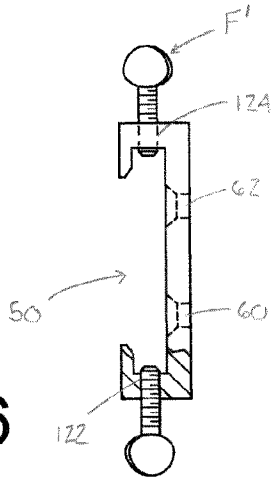
FIG. 6 is a side elevational view, partially broken away, of the base of FIG. 5.

With reference again to FIG. 1, the mounting of the first conventional trestle T to the trestle support apparatus 10 is illustrated. A portion of the trestle is slidingly inserted in the channel 50 such that the trestle can be positioned at various locations along the longitudinal extent of the base 12. To secure the trestle in the channel, the respective side walls 40, 42 of the arm 30, 32 include an array of apertures 122, 124, which can be in registry with each other. In the illustrated embodiment, the apertures 122, 124 are threaded. As shown in FIG. 6, at least one fastener F', such as a thumb screw, can be threaded into one of the apertures such that an end section of the fastener F' engages the trestle, which, in turn, prevents the longitudinal movement of the trestle T in the channel. It should be appreciated that alternate means for securing the trestle are contemplated. For example, an elongated member, such as a rod having a threaded end, can be inserted through one of the apertures such that the threaded end threadingly engages the other aperture.

Figure 12:
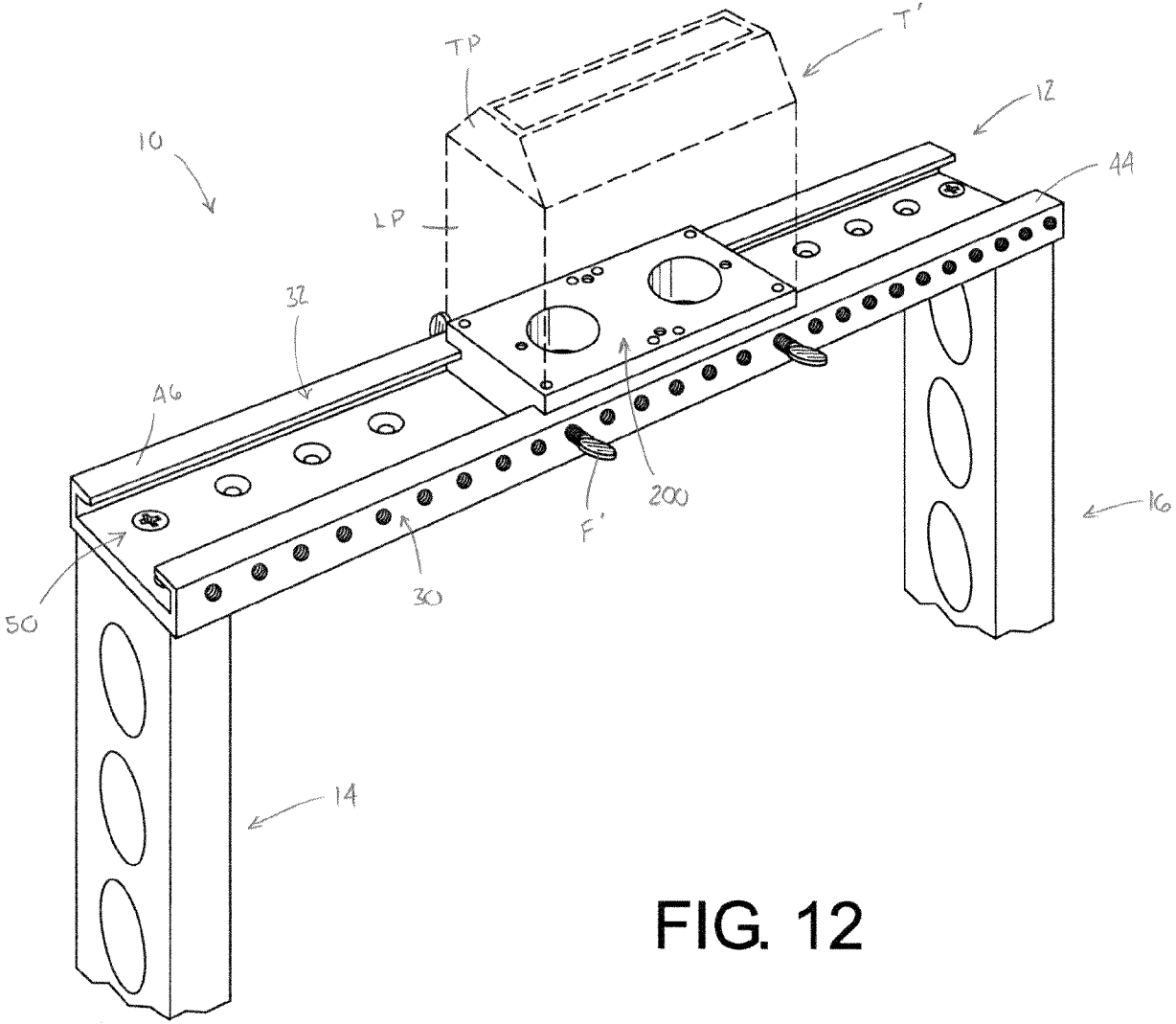
FIG. 12 is a front perspective view of the trestle support apparatus of FIG. 1 showing an adaptor mounted thereto for mounting a second conventional trestle to the trestle support apparatus.
Figure 13:
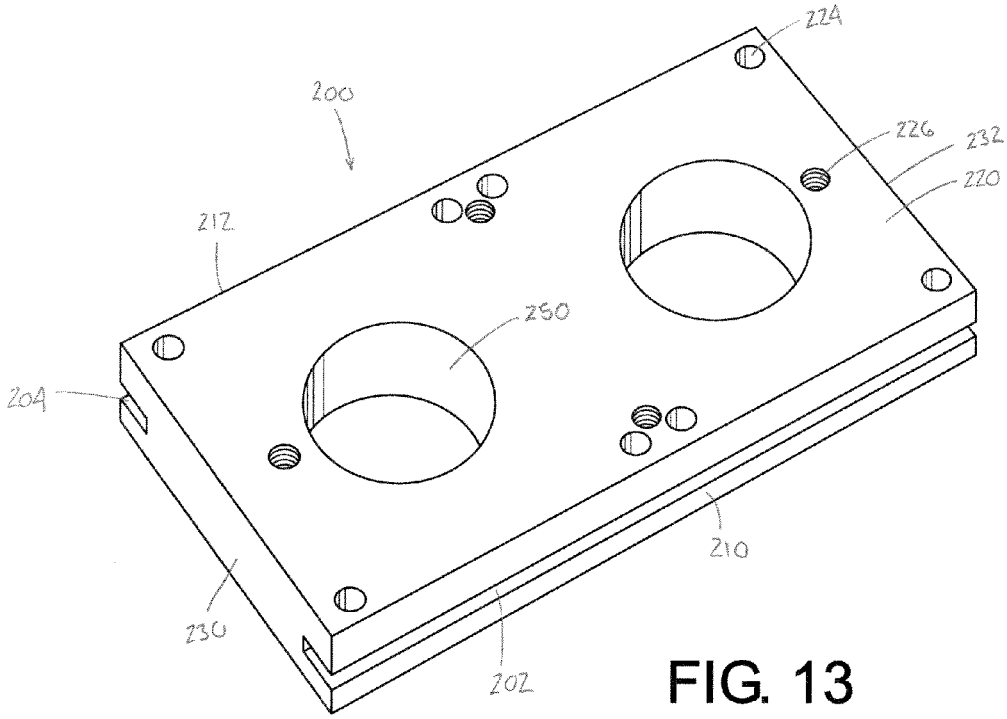
FIG. 13 is a front perspective view of the adaptor of FIG. 12.

As indicated previously, and with reference to FIGS. 12 and 13, an adapter 200 can be mounted to the trestle support apparatus 10. In the depicted embodiment, the adapter is generally rectangular in shape; although, it should be appreciated that alternate shapes and configurations are contemplated. The adapter includes a pair of longitudinally extending grooves 202 and 204 located on opposed sides 210 and 212. Similar to the grooves 110, 112 of the stanchions 14, 16, and as shown in FIG. 12, the adapter grooves 202, 204 are dimensioned to slidingly receive at least a portion of each respective top wall 44, 46 of each arm 30, 32 of the base 12. A top wall 220 of the adapter can be configured to mate to the specific type of second conventional trestle T' being mounted thereto. For example, the second conventional trestle can be a conventional LGB® track top mounting pier TP mounted atop a LGB® layer pier LP. As such, the top wall includes a plurality of spaced apart mounting openings 224 adapted to receive downwardly extending projections (not shown) located on a bottom surface of one of the top pier and the layer pier. The top wall further includes a plurality of threaded apertures 226 for receiving conventional fasteners which can secure one of the second conventional trestle to the adapter. To reduce the weight of the adapter 200, at least one through hole 250 can be located on the top wall.

To mount the adapter 200 to the base 12, the adapter is slidingly inserted in the channel 50 such that the second conventional trestle mounted thereto can be positioned at various locations along the base 12. Similar to the securing of the first conventional trestle to the base, at least one fastener F' is then threaded into one of the apertures 122, 124 located on the base 12 such that an end section of the fastener engages one of the side walls 210, 212 of the adapter. This prevents the longitudinal movement of the adapter in the channel.

Figure 14:
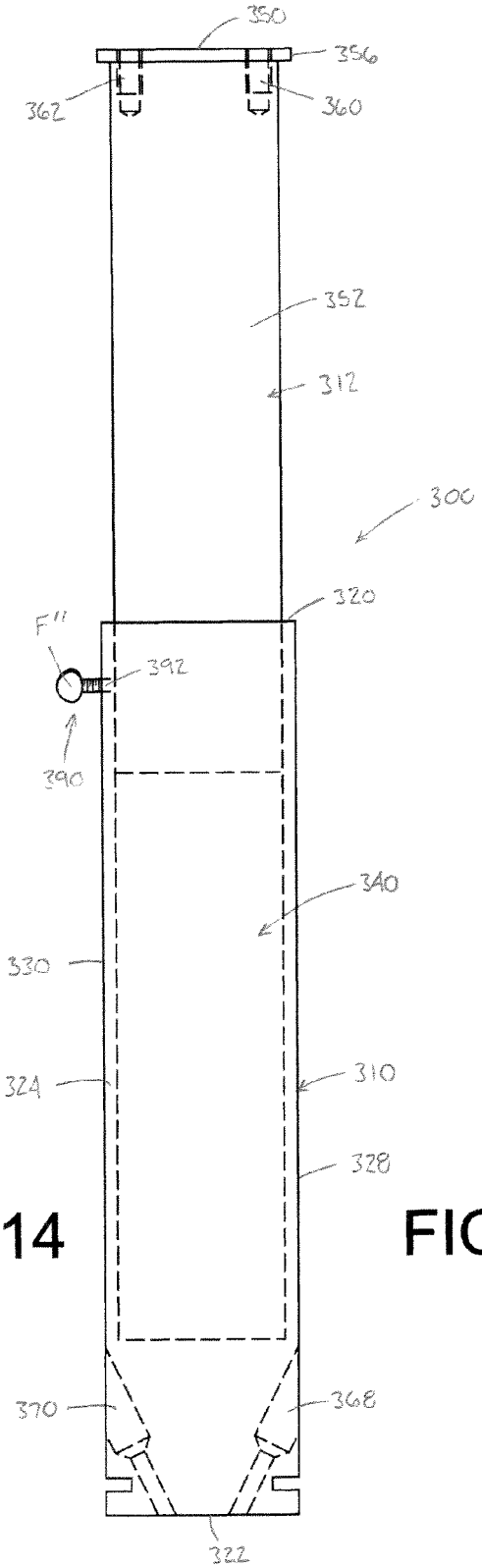
FIG. 14 is a side elevational view of an alternative embodiment of a stanchion in an expanded position of the trestle support apparatus of FIG. 1.
Figure 15:
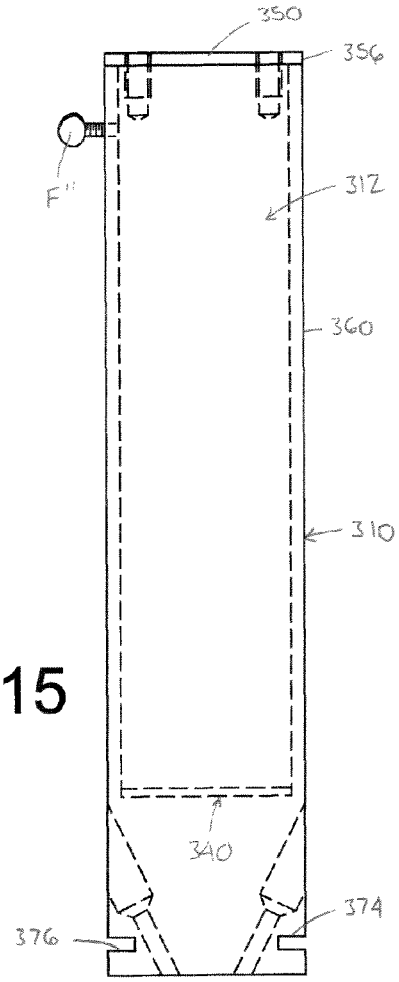
FIG. 15 is a side elevational view of the stanchion of FIG. 14 in a collapsed position.

With reference to FIGS. 14 and 15, an additional embodiment of a stanchion 300 for use with the trestle support apparatus 10 is illustrated.

The stanchion 300 comprises at least two interconnected sections, which can be telescopically received within and secured to each other so that the stanchion has an extended position (FIG. 14) and a collapsed position (FIG. 15). In the depicted embodiment, the stanchion includes a first elongated member 310 and a second elongated member 312 moveably connected to and projecting from the first elongated member. The first elongated member 310 is generally rectangular in shape and includes a top wall 320, a bottom wall 322, opposed side walls (only side wall 324 being illustrated) and opposed front and back walls 328, 330. Again, it should be appreciated that alternate shapes and configurations of the stanchion 300 is contemplated. Extending longitudinally from the top wall towards the bottom wall is a socket 340. Adapted to cooperate with the first elongated member 310 is the second elongated member 312. The second elongated member includes a top wall 350 and a longitudinally extending body 352 which is so sized as to fit in the socket 340 of the first elongated member. The top wall 350 has a larger dimension than the body 352 so that in the collapsed position an outer surface 356 of the top wall is generally contiguous with an outer surface 360 of the first elongated member 310.

Similar to the previous embodiment, to secure the stanchion 300 to the base 12, the top wall 350 includes a pair of threaded apertures 360, 362 which align with the apertures 60, 62 located on the base 12. Fasteners extend through the base apertures and threadingly engages the stanchion apertures. Again, it should be appreciated that alternate means for securing the stanchion to the base are also contemplated. Provided on the front and back walls 328, 330 are respective mounting aperture 368, 370. The mounting apertures extend diagonally though the stanchion and are each dimensioned to receive a conventional fastener for securing the stanchion to a generally flat, subjacent surface. Grooves 374, 376 are located on the respective front and back walls 328, 330 of the stanchion 300 which allow for the stacking of at least two trestle support apparatuses.

A locking structure 390 selectively locks the second elongated member 312 in a desired position in relation to the first elongated member 310. In the depicted embodiment, located adjacent the top wall 320 of the first elongated member 310 is a threaded aperture 392. A fastener F", such as a thumb screw, can be threaded into the aperture 392 such that an end section of the fastener frictionally engages the body 352 of the second elongated member 312, which, in turn, prevents the longitudinal movement of the second elongated member in the socket 340.

It should be appreciated that alternate means for releasably locking the elongated members together are also contemplated. For example, a single aperture can be formed along an exterior periphery of the body 352 and is selectively and slidably aligned with one of a plurality of openings formed along an exterior periphery of the first elongated member 310. An outwardly biasing spring-loaded clip portion can be inserted within the body so that an outwardly biasing button portion selectively projects through the single aperture and one of the plurality of openings of the overlapping first elongated member. The overall length of the collapsible stanchion 300 may be adjusted simply by pressing the button portion inwardly and then axially sliding the first and second elongated members relative to one another until a desired opening of the plurality of openings aligns over the single aperture, at which point the button portion will again project downwardly through the aperture and one of the plurality of openings snapping the first and second elongated members in place.

Figure 18:
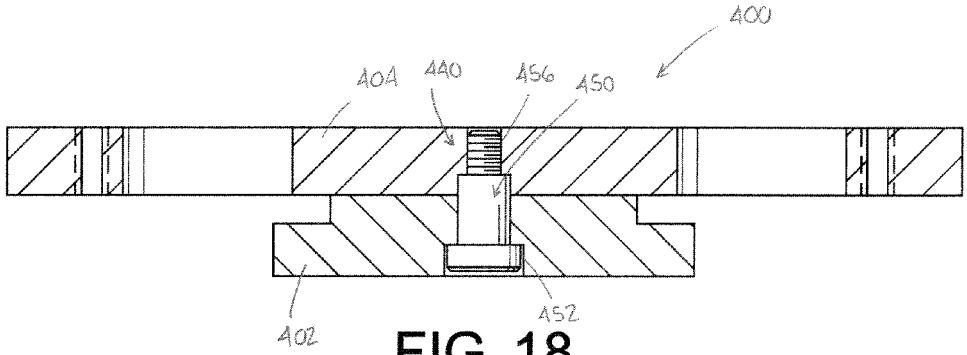
FIG. 18 is a cross sectional view of the adapter of FIG. 17 taken generally along line 18-18 of FIG. 17.
Figure 16:
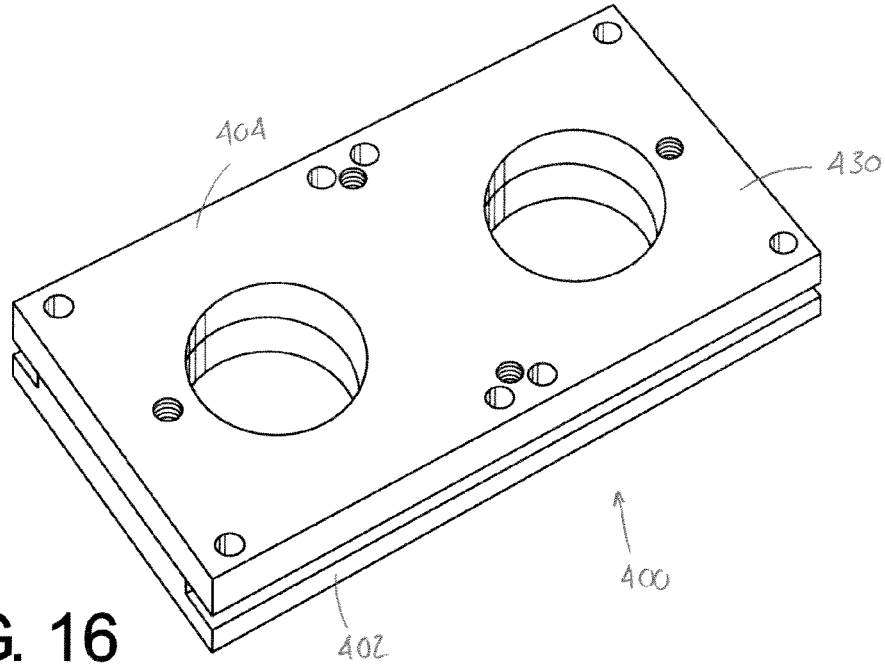
FIG. 16 is a front perspective view of an alternative embodiment of an adaptor in a first position for use with the trestle support apparatus of FIG. 1.
Figure 17:
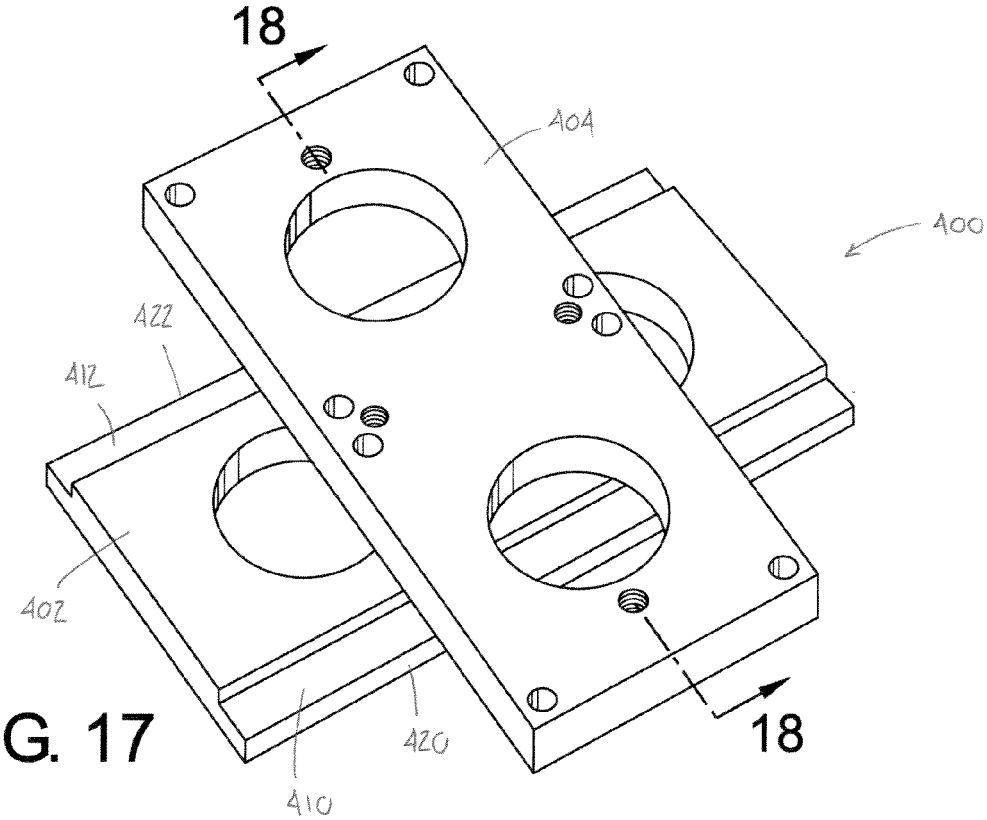
FIG. 17 is a front perspective view of the adaptor of FIG. 16 in a second position.

With reference to FIGS. 16-18, an additional embodiment of an adapter 400 for use with the trestle support apparatus is illustrated.

Similar to adapter 200, adapter 400 is generally rectangular in shape; although, it should be appreciated that alternate shapes and configurations are contemplated. The adapter comprises a first section 402 and a second section 404 movably connected to the first section. The rotation of the second section relative to the first section allows a trestle which is supported on the second section to transverse the base 12 at various angles. The first section 402 includes a pair of longitudinally extending cutouts 410 and 412 located on opposed sides 420 and 422. The cutouts allow the sides 420, 422 of the adapter to be slidingly received within the channel 50 of the base 12. A top wall 430 of the second section is configured to mate to the specific type of the second conventional trestle being mounted thereto. The adapter 400 further includes means 440 for rotating the second section 404 relative to the first section 402. For example, a shoulder screw 450 can be inserted through an aperture 452 located on the first section so that the threaded end section of the screw threadingly engages an aperture 456 of the second section. The shoulder screw allows the second section 404 to rotate relative to the first section 402. It should be appreciated that alternate means for rotating the second section are also contemplated.

The present disclosure has been described with reference to the above embodiments. Obviously, modifications and alterations will occur to others upon reading and understanding the preceding detailed description. For example, it should also be appreciated that the trestle support apparatus 10 can be easily suspended from a ceiling. In this suspended embodiment, the stanchions 14, 16 are mounted in the base channel 50 in a similar manner described above. The stanchions can then be secured to the ceiling via conventional manners. The components of the trestle support apparatus can be color-coded for ease of assembly. It is intended that the present disclosure be construed as including all such modifications and alterations insofar as they come within the scope of the appended claims or the equivalents thereof.

What is claimed is:

1. A trestle support apparatus for use with an associated model track assembly, the associated model track assembly including track sections and trestles of a first configuration and separate track sections and trestles of a second configuration, the trestle support apparatus comprising:

an elongated base including an elongated channel dimensioned to releasably receive and support an associated trestle of a first configuration, said elongated channel being at least partially defined by opposed first and second side walls, a platform, a first arm, including the first side wall, extending outwardly from the platform and a second arm, including the second side wall extending outwardly from the platform and spaced from the first arm, wherein the platform and the first and second arms at least partially define the elongated channel; and first and second stanchions releasably mounted to the base.

2. The trestle support apparatus of claim 1, wherein each of the first and second arms further includes an inwardly extending top wall, the top wall being generally parallel to the platform.

3. The trestle support apparatus of claim 1, wherein the first and second stanchions include fastening means for mounting the first and second stanchions to the base at several predetermined locations along a longitudinal extent of the base.

4. The trestle support apparatus of claim 1, wherein at least one of the first and second stanchions includes a mounting aperture dimensioned to receive an associated fastener for securing the trestle support apparatus to an associated subjacent surface.

5. The trestle support apparatus of claim 1, wherein each of the first and second stanchions includes a pair of spaced apart grooves configured to slidingly receive a portion of the base, the grooves allowing each of the first and second stanchions to be releasably mounted within the elongated channel.

6. The trestle support apparatus of claim 1, wherein the base includes an array of apertures, each of the apertures being configured to receive an associated fastener for engaging the associated trestle of the first configuration and preventing longitudinal movement of the associated trestle in the elongated channel.

7. The trestle support apparatus of claim 1, wherein each of the first and second stanchions includes a first elongated member and a separate second elongated member moveably connected to the first elongated member.

8. The trestle support apparatus of claim 7, wherein the second elongated member is at least partially telescopically received in the first elongated member, and further comprising a locking structure for selectively locking the second elongated member in a desired position in relation to the first elongated member.

9. The trestle support apparatus of claim 1, further comprising an adapter releasably mounted within the elongated channel, the adapter supporting an associated trestle of a second configuration.

10. The trestle support apparatus of claim 9, wherein the adapter includes a pair of longitudinally extending grooves dimensioned to slidingly receive at least a portion of the base, the grooves allowing the adapter to be releasably mounted within the elongated channel.

11. The trestle support apparatus of claim 9, wherein the adapter includes a first section slidingly received in the elongated channel and a second section movably connected to the first section.

12. A trestle support apparatus for use with an associated model track assembly, the associated model track assembly including track sections and trestles of a first configuration and separate track sections and trestles of a second configuration, the trestle support apparatus comprising:

an elongated base including a platform and first and second arms extending outwardly from the platform, the platform and the first and second arms defining an elongated channel dimensioned to releasably receive and support an associated trestle of a first configuration; and first and second stanchions releasably mounted to the base, the first and second stanchions being in spaced apart relation such that at least two parallel associated track sections of one of the first and second configurations can be positioned beneath the base.

13. The trestle support apparatus of claim 12, wherein each of the first and second stanchions includes a first elongated member and a separate second elongated member, wherein the second elongated member is at least partially telescopically received in the first elongated member.

14. The trestle support apparatus of claim 12, further comprising an adapter releasably mounted within the elongated channel, the adapter supporting an associated trestle of a second configuration.

15. The trestle support apparatus of claim 14, wherein the adapter includes a first section slidingly received in the elongated channel and a second section rotatably connected to the first section.

16. A trestle support apparatus for use with an associated model track assembly, the associated model track assembly including track sections and trestles of a first configuration and separate track sections and trestles of a second configuration, the trestle support apparatus comprising:

an elongated base including an elongated channel dimensioned to releasably receive and support an associated trestle of a first configuration; and first and second stanchions releasably mounted to the base, each of the first and second stanchions including a first end section configured to be releasably mounted beneath the base and a second end section configured to be releasably mounted within a second elongated base, the first and second stanchions include a first elongated member and a separate second elongated member, wherein the second elongated member is at least partially telescopically received in the first elongated member.

17. The trestle support apparatus of claim 16, further comprising an adapter releasably mounted within the elongated channel, the adapter supporting an associated trestle of a second configuration.

18. The trestle support apparatus of claim 17, wherein the adapter includes a first section and a separate second section rotatably connected to the first section.

19. A trestle support apparatus for use with an associated model track assembly, the associated model track assembly including track sections and trestles of a first configuration and separate track sections and trestles of a second configuration, the trestle support apparatus comprising:

an elongated base including an elongated channel dimensioned to releasably receive and support an associated trestle of a first configuration, said elongated channel being at least partially defined by opposed first and second side walls; and first and second stanchions releasably mounted to the base, each of the first and second stanchions including a pair of spaced apart grooves configured to slidingly receive a portion of the base, the grooves allowing each of the first and second stanchions to be releasably mounted within the elongated channel.

20. A trestle support apparatus for use with an associated model track assembly, the associated model track assembly including track sections and trestles of a first configuration and separate track sections and trestles of a second configuration, the trestle support apparatus comprising:

an elongated base including an elongated channel dimensioned to releasably receive and support an associated trestle of a first configuration, said elongated channel being at least partially defined by opposed first and second side walls; and first and second stanchions releasably mounted to the base, each of the first and second stanchions including a first elongated member and a separate second elongated member at least partially telescopically received in the first elongated member, and further comprising, a locking structure for selectively locking the second elongated, member in a desired position in relation to the first elongated member.

21. A trestle support apparatus for use with an associated model track assembly, the associated model track assembly including track sections and trestles of a first configuration and separate track sections and trestles of a second configuration, the trestle support apparatus comprising:

an elongated base including an elongated channel dimensioned to releasably receive and support an associated trestle of a first configuration, said elongated channel being at least partially defined by opposed first and second side walls;

first and second stanchions releasably mounted to the base; and an adapter releasably mounted within the elongated channel, the adapter supporting an associated trestle of a second configuration.

22. The trestle support apparatus of claim 21, wherein the adapter includes a pair of longitudinally extending grooves dimensioned to slidingly receive at least a portion of the base, the grooves allowing the adapter to be releasably mounted within the elongated channel.

23. The trestle support apparatus of claim 21, wherein the adapter includes a first section slidingly received in the elongated channel and a second section movably connected to the first section.

24. A trestle support apparatus for use with an associated model track assembly, the associated model track assembly including track sections and trestles of a first configuration and separate track sections and trestles of a second configuration, the trestle support apparatus comprising:

an elongated base including an elongated channel dimensioned to releasably receive and support an associated trestle of a first configuration;

first and second stanchions releasably mounted to the base, each of the first and second stanchions including a first end section configured to be releasably mounted beneath the base and a second end section configured to be releasably mounted within a second elongated base; and an adapter releasably mounted within the elongated channel, the adapter includes a first section and a separate second section rotatably connected to the first section and supporting an associated trestle of a second configuration.

* * * * *